United States Patent [19]

Hall et al.

[11] 4,324,959

[45] Apr. 13, 1982

[54] PRE-INSERTION RESISTOR MECHANISM FOR A CIRCUIT INTERRUPTING DEVICE

[75] Inventors: Walter J. Hall, Evanston; John C. Opfer, Deerfield, both of Ill.

[73] Assignee: S&C Electric Company, Chicago, Ill.

[21] Appl. No.: 951,685

[22] Filed: Oct. 16, 1978

[51] Int. Cl.[3] ..... H01H 33/16

[52] U.S. Cl. ..... 200/144 AP; 200/148 A; 200/150 J

[58] Field of Search ..... 200/144 AP, 237, 146 R, 200/147, 148 A, 148 B, 150 G, 325, 145

[56] References Cited

U.S. PATENT DOCUMENTS

| | | | |
|---|---|---|---|
| 4,009,458 | 2/1977 | Kishi et al. | 200/150 G X |
| 4,069,406 | 1/1978 | Meinders | 200/145 X |
| 4,072,836 | 2/1978 | Bischofberger et al. | 200/325 X |

FOREIGN PATENT DOCUMENTS

| | | | |
|---|---|---|---|
| 430452 | 6/1935 | United Kingdom | 200/144 AD |

*Primary Examiner*—James R. Scott
*Attorney, Agent, or Firm*—John D. Kaufmann

[57] ABSTRACT

A pre-insertion resistor mechanism for a circuit interrupting device of the type which has a pair of normally-engaged contacts. One of the contacts is movable relative to the other contact in an arc-extinguishing environment to selectively separate the contacts to open a gap therebetween to effect circuit interruption. The contacts are continuously, electrically connected to respective, opposed circuit-connectable terminals on the device. The pre-insertion resistor mechanism includes a pre-insertion resistor electrically connected at one end to one of the terminals. The other end of the resistor carries a stationary electrode. A movable electrode assembly which is electrically connected to the other terminal is mechanically coupled to the movable contact so that upon movement thereof to open the gap, the movable electrode simultaneously separates from the stationary electrode. After a predetermined amount of the movement of the electrode has taken place, a latch assembly uncouples the movable electrode assembly from the movable contact permitting the movable electrode assembly to move back toward the stationary electrode. In this way, when the contacts are subsequently re-engaged, the movable electrode assembly leads the main movable contact so that the movable electrode assembly re-engages the stationary electrode prior to the engagement of the contacts. Thus, the circuit is first made between the electrodes, whereat some arcing occurs, with the resistor in parallel with the gap between the main electrodes. When the contacts re-engage, they again carry most of the current through the interrupting device.

13 Claims, 6 Drawing Figures

| | |
|---|---|
| FIG. 1A | FIG. 1B |

PRE-INSERTION RESISTOR MECHANISM FOR A CIRCUIT INTERRUPTING DEVICE

BACKGROUND OF THE INVENTION

1. Field of the Invention

This invention relates to a pre-insertion resistor mechanism, and, more specifically, to a pre-insertion resistor mechanism for use with circuit interrupting devices. Additionally, the present invention relates to an improved circuit interrupting device into which is incorporated the pre-insertion resistor mechanism of the present invention.

2. Prior Art

The use of a pre-insertion resistor in a circuit interrupting device to protect circuits during closing operations thereof is, in general, well known. See U.S. Pat. Nos. 4,069,406; 4,072,836; and 3,291,947. As the circuit interrupting device is closed, the pre-insertion resistor is connected in parallel with a gap previously opened therein. When the pre-insertion resistor is placed in parallel with the gap, the circuit voltage measured to ground (generally line-to-ground voltage) is dropped thereacross. Accordingly, the current flowing through the resistor is determined by V/Z, where V is the line-to-ground voltage of the circuit and Z is the vector sum of the resistance of the pre-insertion resistor and the surge impedance of inductive and capacitive elements (such as capacitor banks, reactors, bus work) connected to and in the circuit. The current determined by this calculation is often referred to as the inrush current and may achieve a substantially high level for some fraction of a second, especially where the device is used in conjunction with a capacitor bank. Clearly, inrush currents having high magnitudes may damage the circuit. For example, without pre-insertion resistors, the inrush current often reaches values of about 10 to 30 thousand amperes—a magnitude which can lead to distress or damage of the circuit; with a pre-insertion resistor, the initial inrush current is relatively lower— generally 2–4 thousand amperes—and can be carried by the circuit without undue distress. Following the initial inrush current, the current through the pre-insertion resistor is ultimately limited by the steady state impedance of capacitor banks, and other items (loads, reactors, etc.) connected to and in the circuit. Consequently, following the initial inrush current, the current flow through the pre-insertion resistor is generally within the range of 100 to 400 amperes. When the pre-insertion resistor is first inserted into the circuit in parallel with the gap, its electrode structure must be able to withstand some initial arcing, as is well known. However, in view of the fact that pre-insertion resistors ordinarily carry little or none of the continuous current through the interrupting device, such electrode structure need only be sufficiently robust to withstand initial arcing and momentary currents up to about 4,000 amperes from time to time.

Quickly following the time when the initial inrush current has subsided and the current through the pre-insertion resistor has dropped to the substantially lower level of 100–400 amperes, contacts of the interrupting device re-engage. If the device is switching capacitor banks, the banks discharge directly through the contacts, the current being now limited by the surge impedance of the banks and the bus work. Generally, it has been found that the value of the resistor may be chosen so that—considering the electrical characteristics of the circuit, especially of the banks—the magnitude of the discharge current is substantially the same as the magnitude of the initial inrush current. Thus, if the circuit is able to carry the 2,000–4,000 ampere initial inrush current, it is also able to carry the similar discharge current.

The resistance of the interface between the contacts of circuits interrupting devices is typically on the order of micro-to-milli-ohms, whereas the resistance of pre-insertion resistors is typically on the order of 100 ohms. Accordingly, the engagement of the contacts shunts the majority of the current therethrough so that the pre-insertion resistor is not called upon to thereafter carry any substantial part of the continuous or normal current through the circuit interrupting device.

A wide variety of schemes are known for inserting pre-insertion resistors in parallel with an already open gap between previously separated contacts of a circuit interrupting device, while preventing such pre-insertion resistors from being connected across such gap as it is opened during disengagement of the contacts. Most of these schemes involve complicated linkages, lost motion devices, dashpots and piston-cylinders, which add to the cost of the circuit interrupting device, which are complicated to manufacture and assemble, and which are difficult to adjust.

Accordingly, it is an object of the present invention to provide a mechanism for connecting a pre-insertion resistor in electrical parallel with an open gap between disengaged contacts of a circuit interrupting device, such mechanism being simple, economical, easy to manufacture, and convenient to adjust, or requiring no adjustment.

SUMMARY OF THE INVENTION

The present invention relates to an improved pre-insertion resistor mechanism for a circuit interrupting device. The device is of the general type having a pair of normally-engaged contacts which are relatively movable along a first path in an arc-extinguishing environment. The contacts are normally engaged and are disengageable by relative movement, usually of a movable contact along the path in a first direction, to establish a gap between the contacts. The contacts are continuously, electrically connected to respective opposed circuit-connectable terminals on the device. The improved pre-insertion resistor mechanism includes a resistor which is continuously, electrically connected at one end to one of the terminals or contacts. The other end of the resistor carries a stationary electrode. A movable electrode, which is continuously, electrically connected to the other terminal or contact, is movable along a second path, parallel to the first path into and out of contact with the stationary electrode. A first facility, responsive to disengagement of the main contacts due to movement of the movable contact, simultaneously and conjointly moves the movable electrode in the first direction along the second path out of engagement with the stationary electrode. This movement is in phase with and occurs at the same time as movement of the movable contact. Such movement of the movable electrode is effected so that the resistor is not electrically paralleled with the gap during such movement of the movable contact in the first direction. A facility responsive to a predetermined amount of movement of the movable contact moves the movable electrode back along the second path in an opposed second direction toward the stationary electrode. During movement of the movable contact toward the stationary contact, the pre-insertion resistor is inserted in electrical parallel with the gap before the contacts re-engage.

In preferred embodiments, after a predetermined amount of movement of the movable contact, facilities, which may include a biasing spring, move the movable electrode back toward the stationary electrode but maintain a separation therebetween. Thus, following full opening of the contacts, reclosure thereof effects engagement between the electrodes to place the resistor in parallel with the gap before re-engagement of the main contacts.

In another preferred embodiment, a sleeve surrounds and is mechanically coupled to the movable contact for movement therewith. An end of the sleeve defines a shoulder. A leaf spring is carried by a member which also mounts the movable electrode. The leaf spring includes a finger which normally engages the shoulder so that upon movement of the movable contact and the sleeve, the member, the leaf spring, and the movable electrode are carried in the first direction to break the engagement between the electrodes. Engagement of the shoulder and the finger also prevents the biasing spring, which acts between the member and the sleeve, from moving the member. When the predetermined amount of movable contact movement is effected, and therefore, a predetermined amount of sleeve movement is effected, a stationary cam moves the finger away from the shoulder by flexing the leaf spring. At this point, the biasing spring moves the movable electrode back toward the stationary electrode. In this condition, re-engagement of the contacts is preceded by re-engagement of the electrodes to place the pre-insertion resistor in parallel with the gap prior to engagement of the contacts.

DETAILED DESCRIPTION OF THE INVENTION

Figures 1A, 5:
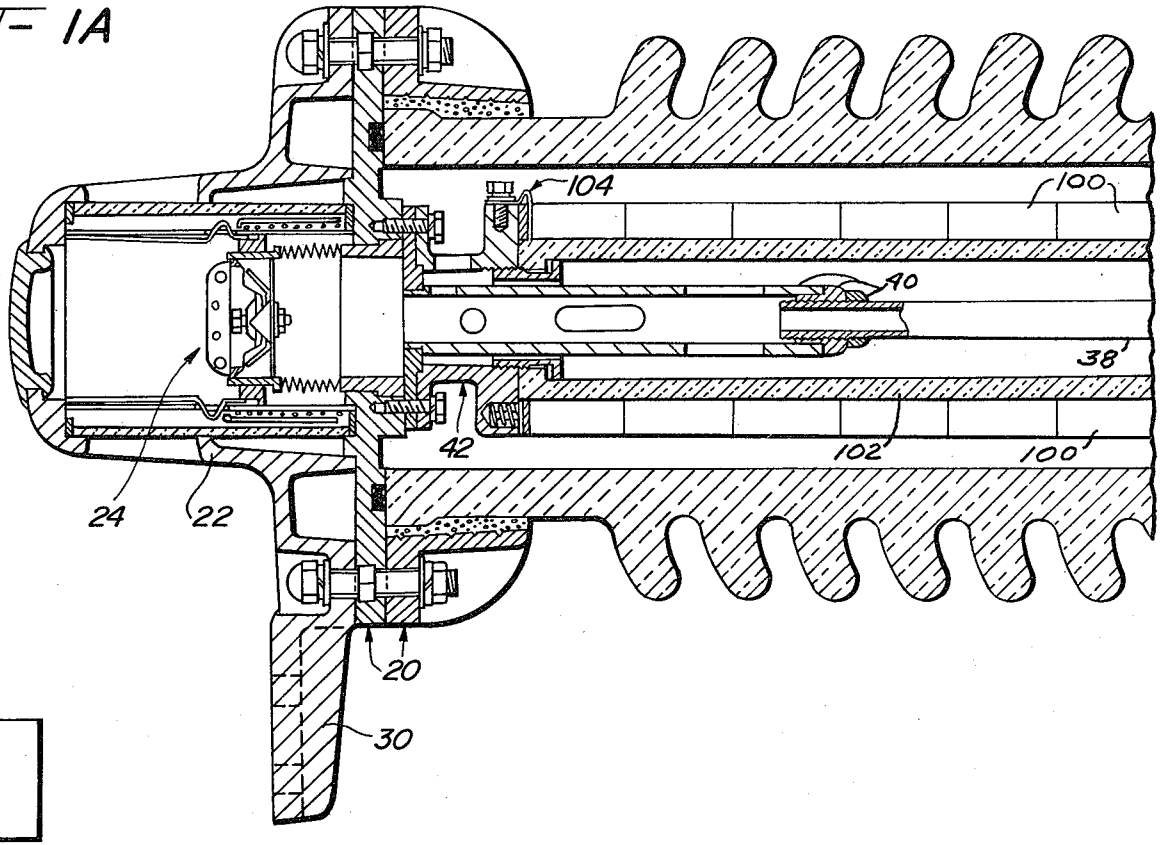
FIGS. 1A and 1B are, taken together as FIG. 1, an overall, partially-sectioned view of a typical interupting device usable with and including the pre-insertion resistor mechanism of the present invention.
FIG. 5 indicates the manner of putting together FIGS. 1A and 1B.
Figure 1B:
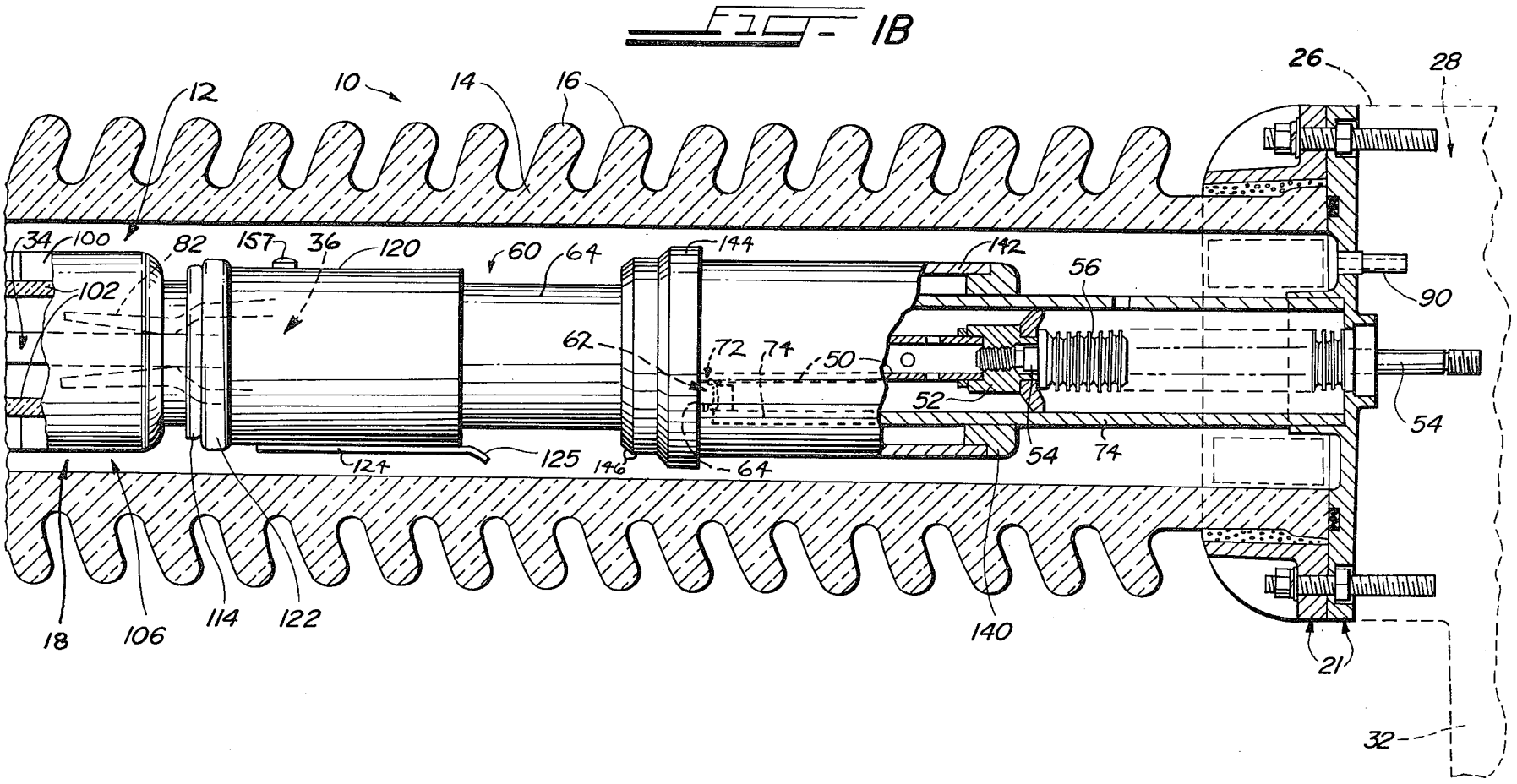

Referring first to FIG. 1, there is shown a partially sectioned, general view of an interrupting device 10 with which the pre-insertion resistor mechanism 12 of the present invention may be used. The interrupting device 10 depicted in FIG. 1 is similar to one embodiment of the interrupting device shown in co-pending, commonly-assigned, co-filed U.S. patent application, Ser. No. 951,687, filed Oct. 16, 1978, in the name of Bernatt. It should be understood that the pre-insertion resistor mechanism 12 of the present invention is usable with other types of circuit interrupting devices 10 with only minor modifications thereof, as should be clear from the following description. Typical of such interrupting devices are those depicted in commonly-assigned U.S. Pat. Nos. 3,030,481; 3,163,736; 3,508,022; and 3,769,477.

The interrupting device 10 is here briefly described for purposes of completing the background and environment of use of the mechanism 12 of the present invention.

The interrupting device 10 includes an open-ended, elongated, insulative, generally cylindrical housing 14, typically of porcelain and preferably having on the surface thereof a plurality of leakage-distance-increasing skirts 16. The housing 14 contains the various elements of an interrupting unit 18, as well as the mechanism 12 of this invention. The housing 14 is closed and preferably sealed at each open end by appropriate end members 20 and 21, which may be attached to the housing 14 by any convenient means. The left-hand end member 20 is electrically connected to, and has attached thereto an end housing 22 including a pressure relief and pressure indicating mechanism 24, which is more completely described in commonly-assigned, co-pending, co-filed U.S. patent application, Ser. No. 951,686, filed Oct. 16, 1978 in the name of Bernatt. The right-hand end member 21 may have attached thereto, and be in electrical contact with, a housing 26 for an operating mechanism (not shown, but indicated generally at 28) which may include a sensing and tripping mechanism for opening the interrupting device 10 and a high-speed closing mechanism for closing the device. The sensing and tripping mechanism of the operator 28 may be of the type more completely disclosed in co-pending, commonly-assigned, U.S. patent application, Ser. No. 930,774, filed Aug. 3, 1978 now U.S. Pat. No. 4,203,083 in the names of Opfer and Vojta; the closing mechanism may be of any known type.

The interrupting device 10 is connected into a circuit (not shown) via a first terminal pad 30 which may be formed integrally with the housing 22 and which is therefore electrically connected to the left-hand end member 20. A second circuit connection to the device may be provided by a second terminal pad 32 which may be formed integrally with the housing 26 and which is therefore electrically connected to the right-hand end members 21.

Figure 2:
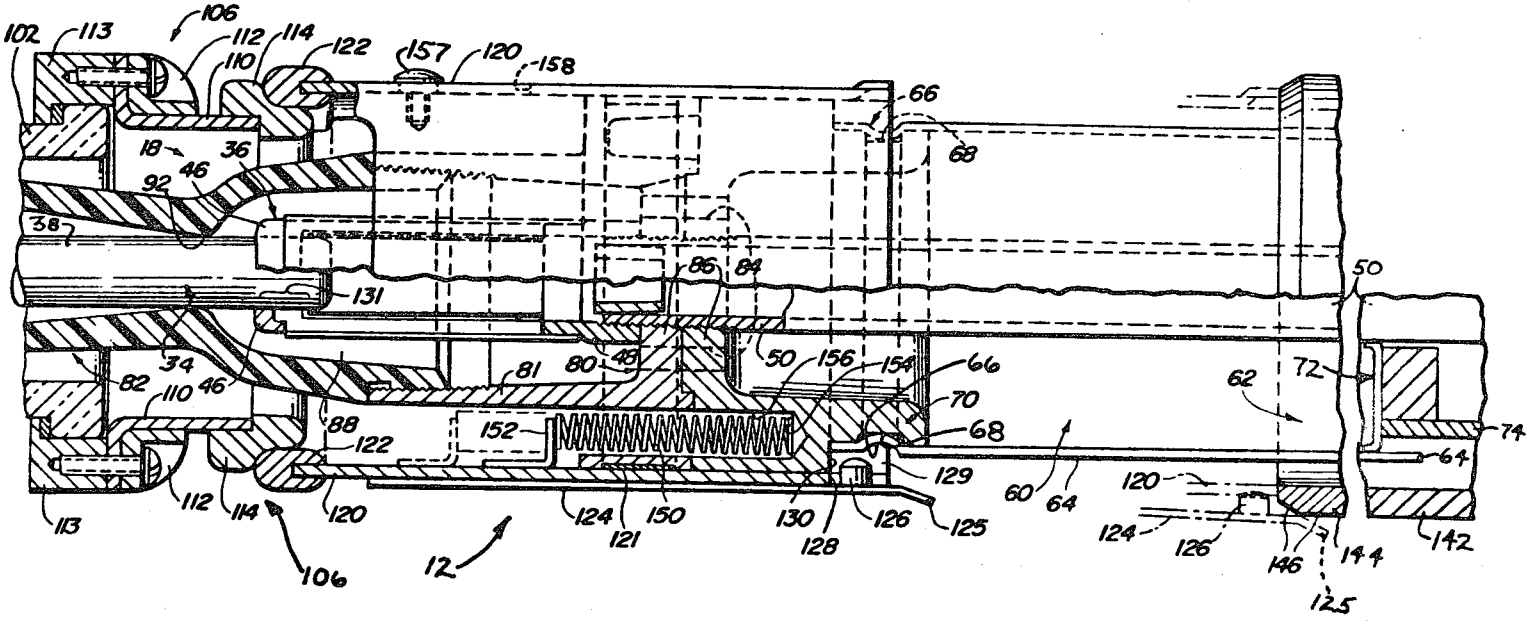
FIG. 2 is a magnified portion of FIG. 1 showing in greater detail the structure of the pre-insertion resistor mechanism in accordance with the principles of the present invention.

The interrupting unit 18 of the interrupting device 10 includes a stationary contact 34 and a movable contact 36. The movable contact 36 normally engages the stationary contact 34 as shown in FIG. 2 and is movable along a first path generally concurrent with the major axis of the housing 14 in a first direction to disengage the contacts 34 and 36 (FIG. 3) and in a second opposed direction along the first path to re-engage the contacts 34 and 36 (FIG. 2).

The stationary contact 34 includes an elongated, conductive member 38 which is attached by any convenient method to an elongated conductive support 40. The support 40 is in turn mounted to and electrically connected with a double-flanged member 42 which is mounted to and electrically connected with the left-hand end member 20.

Figure 3:
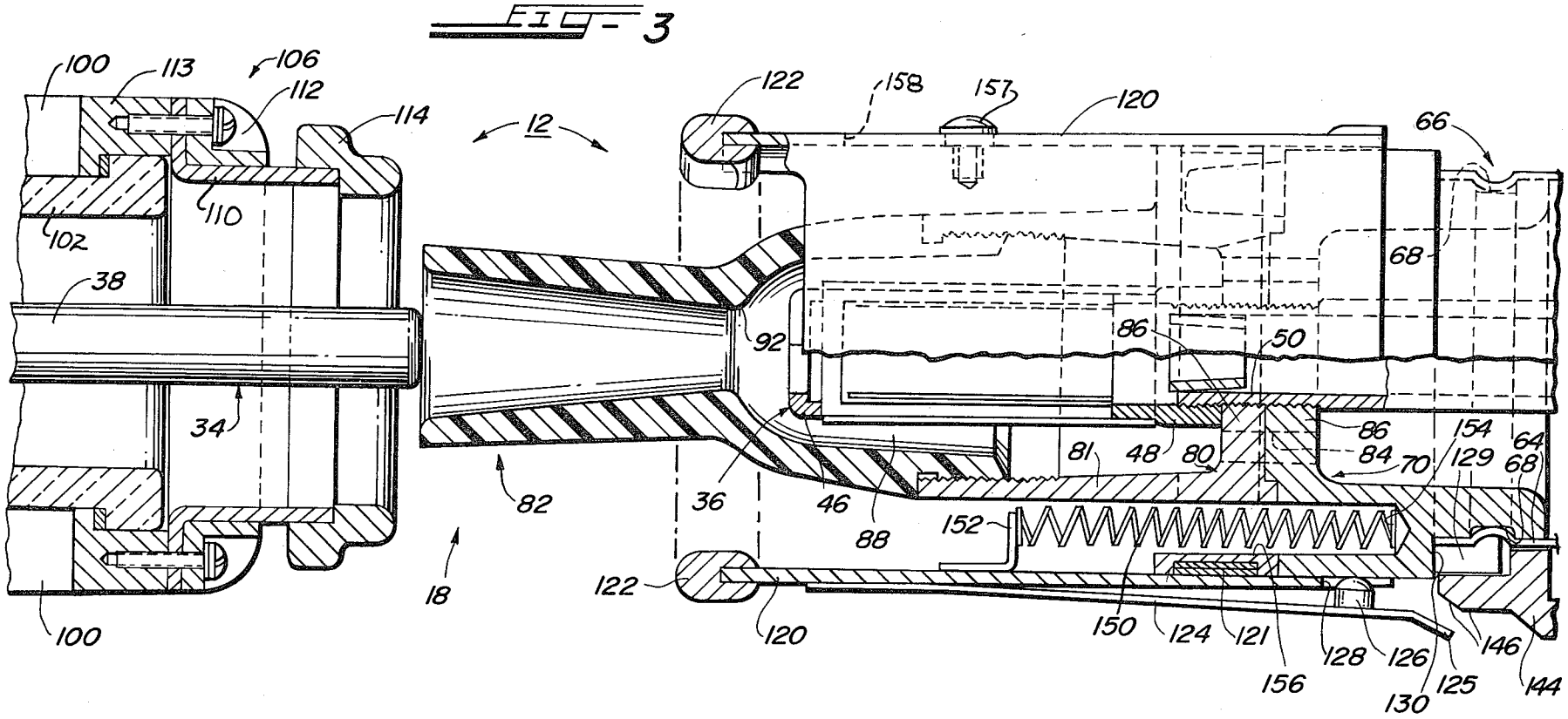
FIG. 3 depicts the pre-insertion resistor mechanism of the present invention in a manner similar to FIG. 2, but after contacts of the device have fully opened.

Referring additionally to FIG. 3, the movable contact 36 into which the stationary contact 34 is insertable during engagement between the contacts 34 and 36 preferably terminates in a plurality of contact fingers 46 formed integrally with a conductive collar 48. The collar 48 is connected by any convenient method to the left end of a movable, elongated conductive tube 50. The conductive tube 50 is in turn connected at its right-hand end to an attachment nipple 52 (FIG. 1B) which is connected to the left end of an operating rod 54 connected to and reciprocated by the operating mechanism 28. As more completely described in the co-pending application of Opfer and Vojta, the operating rod 54 moves through the right-hand end member 21. A flexible bellows 56 is sealed between the connection nipple 52 and the right-hand end member 21 to prevent the leakage from within the housing 14 of pressurized arc-extinguishing gas contained therein.

A cylinder 60 of a piston-cylinder arrangement 62 is defined by the outside of the tube 50 and the inside of a movable, coaxial metal cylinder 64 surrounding the tube 50. The metal cylinder 64 is attached (as by crimping, deformation, magnaforming, or the like) as indicated at 66 to a peripheral groove 68 formed in a first sleeve 70. The first sleeve 70 is connected to the left-hand end of the tube 50 near the mounting of the sleeve 48 thereto for movement therewith.

A stationary piston 72 of the piston-cylinder arrangement 62 is carried by a hollow support 74 which is attached, at its right-hand end, to the right end member 21 and which coaxially surrounds the operating rod 54 and the tube 50. Thus, the piston 72 is stationary while the members defining the cylinder 60 of the piston-cylinder arrangement 62, namely the tube 50 and the metal cylinder 64, are jointly movable.

A second sleeve 80 is connected to the left-hand end of the tube 50 in a manner similar to, and near, the first sleeve 70. A portion 81 of the sleeve 80 surrounds the movable contact 36. The sleeves 70 and 80 may be formed integrally if convenient. The second sleeve 80 carries on the portion 81 a nozzle structure 82 which initially surrounds both the movable and the stationary contacts 34 and 36. The cylinder 60 of the piston-cylinder arrangement 62 is connected by passageways 84 formed through transverse walls 86 of the sleeves 70 and 80 to a chamber 88 defined between the movable contact 36 and the interior wall of the nozzle structure 82.

Generally, the interrupting device 10 of the co-pending application of Bernatt operates as follows. When circuit interruption is desired, the operating rod 54 is moved rightwardly. Such rightward movement compresses the bellows 56, but maintains gas pressure within the housing 14, which may be pressurized through a filling port 90 in the right-hand end plate 21 with an arc-extinguishing gas such as $SF_6$, or the like. Rightward movement of the operating rod 54 also rightwardly moves the tube 50 (via the connection nipple 52) and the movable contact 36 righwardly. Additionally, both sleeves 70 and 80 move rightwradly at the same time due to their connection to the tube 50. Rightward movement of this entire assembly causes the movable contact 36 to disengage the stationary contact 34 and to open a gap therebetween. Simultaneously, the volume of the cylinder 60 of the piston-cylinder arrangement 62 is decreased due to the relative movement of the piston 72 and both the metal cylinder 64 and the tube 50. Such volume decrease forces the $SF_6$ gas within the cylinder 60 through the passageways 84 into the chamber 88, and from there to and across the gap now being opened between the stationary and movable contacts 34 and 36. Ultimately, at a subsequent current zero, the high-voltage arc, which is formed between and terminates on the contacts 34 and 36, is extinguished. A constriction 92 in the rightwardly moving nozzle structure 82 ensures that the gas flowing therepast reaches sonic or near sonic velocity to further aid in circuit interruption. The significance of describing herein the type of circuit interrupting device 10 disclosed in the copending application of Bernatt is that it is easy and convenient to tie-in mechanically to appropriate structure of the mechanism 12, in this case the sleeve 70, which moves simultaneously with the movable contact 36. Various modifications, well within the skill of the art, can be made to other types of prior art circuit interrupting device to provide a member or members which similarly move simultaneously with a movable contact anmd which are accessible for attachment to, or operation of, the mechanism 12.

Referring now to FIGS. 1–3, the pre-insertion resistor mechanism 12 of the present invention is shown and described in greater detail. The pre-insertion resistor mechanism 12 includes one or more resistors 100 which may be coaxially arranged about a ceramic support member 102 which extends from, and is attached to, the flange member 42. The support member 102 preferably coaxially surrounds the support 40. As noted, there may be one or more resistors 100. Typically, such resistors 100 are made of a carbon composition, and where more than one resistor 100 is used, they may be arranged end-to-end as shown. The resistor 100, or one end of an end-to-end arrangement thereof, is connected at one end to the flanged member 42. To facilitate such electrical connection, any convenient conductive structure, generally indicated at 104, may be utilized. Thus, one end of the resistor or resistors 100 is in constant electrical contact with the left-hand end member 20 and the terminal pad 30. The other end of the resistor or resistors 100 carries a stationary electrode assembly 106 which may be mounted both to the resistor or resistors 100 and to the support member 102.

The stationary electrode assembly 106 includes a single cylindrical, or a plurality of, L-shaped (in cross-section) members generally designated 110, mechanically mounted by and electrically connected with a mounting ring 112. The mounting ring 112 traps the members 110 between itself and a cylindrical mounting pad 113 mounted on the support member 102. The member or members 110 carry thereon one or more stationary electrodes 114. The stationary electrodes 114 may be in a finger-like arrangement coaxial with the axis of the housing 14. Preferably, a single circular, toroidal stationary electrode 114 is used. The stationary electrode 114 is made of a refractory material which is capable of withstanding high temperatures and which is possessed of sufficient electrial conductance. Preferred materials for the stationary electrode 114 are copper-tungsten, carbon or graphite. The stationary electrode 114 is in electrical contact with the left-hand terminal pad 30 via the resistor or resistors 100, the conductive structure 104, the flanged member 42, the end member 20, and the bell housing 22.

A cylindricl, conductive sleeve 120 surrounds the sleeves 70 and 80 and is movable relative thereto. Electrical continuity is maintained between the sleeve 120 and the sleeves 70 and 80 by a sliding contact 121 held in a groove in the sleeve 80. The sleeve 120 carries, at its left-hand end, one or more refractory movable electrodes 122 which are arranged to mate with and normally engage the stationary electrode 114. The movable electrodes 122 are preferably made of copper-tungsten, carbon or graphite.

The sleeve 120 carries on the outer surface thereof one or more flexible leaf spring-like members 124, (only one is shown), preferably mounted as by brazing or welding at their left-hand end to the sleeve 120 near the electrodes 122. The right-hand end of the leaf spring 124 is formed outwardly in a flare 125 and carries a finger 126 biased by the normal configuration of the leaf spring 124 to extend through an opening or notch 128 formed through the right end of the sleeve 120. The finger 126 normally extends into an opening 129 formed in the right end of the sleeve 70 to engage a shoulder 130 forming a wall of the opening 129. The opening 129 is normally aligned with the opening 128. Conveniently, the openings 128 and 129 are in the vicinity of the crimping 66 of the metal cylinder 64 to the first sleeve 70.

During an opening operation of the interrupting device 10, the operating rod 54 is moved rightwardly. Such rightward movement moves the connection nipple 52 and the tube 50 rightwardly. Additionally, the movable contact 36 and the sleeves 70 and 80 attached to the tube 50 more rightwardly. Such rightward movement of the sleeve 70 moves the sleeve 120 rightwardly due to the normal engagement between the finger 126 on the leaf spring 124 and the shoulder 130. Such rightward movement moves the movable electrode 122 away from the stationary electrode 114, breaking electrical contact therebetween (compare FIGS. 2 and 3). The breaking of this contact occurs before the stationary and moveable contacts 34 and 36 completely disengage due to the amount of overlap 131 therebetween, as may be seen in FIG. 2. Thus, the pre-insertion resistors 100 are removed from the circuit between the terminal pads 30 and 32 prior to the disengagement of the stationary and movable contacts 34 and 36. Accordingly, circuit interruption is effected by such contacts 34 and 36, and not arc is formed between the electrodes 114 and 122.

The above-described rightward movement of the tube 50 also causes rightward movement of the metal cylinder 64. Both of which move relative to the piston 72 causing a decrease in the volume of the cylinder 60 defined thereby. Therefore, circuit interruption by the contacts 34 and 36 is aided by the $SF_6$ gas which is forced at high velocity by the piston-cylinder arrangement 62 through the passageways 84, the chamber 88, and the nozzle 82 to the now-opening gap between the contacts 34 and 36.

Rightward movement of all of the above elements continues, and, at some subsequent current zero, the circuit is interrupted and the arc formed between the contacts 34 and 36 is extinguished.

Mounted to the hollow support 74 by a grooved ring (FIG. 1B) is a stationary tubular member 142 which holds, at its left end, a cam ring 144. The cam ring 144 includes, in part, cam surfaces 146 so arranged that near the extreme of the rightward movement of the finger 126, the cam surfaces 146 engage the flare 125. As shown in phantom in FIG. 2, engagement of the flare 125 by the cam surfaces 146 flexes the leaf spring 124 outwardly to disengage the finger 126 from the shoulder 130 by moving the finger 126 out of the opening 129.

A compression spring 150 located between the sleeves 70 and 80, on the one hand, and the sleeve 120, on the other hand, is normally compressed between an "L" member 152 attached to the sleeve 120 and the bottom 154 of a blind passage 156 formed in the sleeves 70 and 80. In its compressed state, the compression spring 150 biases the sleeve 120 and the movable electrode 122 carried thereby leftwardly, that is, toward the stationary electrode 114. Such biasing action of the compression spring 150 is normally prevented from effecting such leftward movement of the movable electrode 122, however, due to the normal engagement between the finger 126 and the shoulder 130. When the elements which move in conjunction with the operating rod 54 are near the full extent of their rightward movement, and the finger 126 disengages the shoulder 130, the compression spring 150 moves the sleeve 120 and the movable electrode 122 leftwardly toward the stationary electrode 114 as shown in FIG. 3. The cam surfaces 146 are so arranged that they not only flex the leaf spring 124 and the finger 126 outwardly, but also prevent the finger 126 from reentering the opening 129 as long as the sleeves 70 and 80 are positioned rightwardly, as in FIGS. 2 and 3. Accordingly, having been moved outwardly by flexing of the leaf spring 124, the finger 126 is free to ride on and over the outer surface of the sleeve 70. Thus, the compression spring 150 advances the movable electrode 122 back toward the stationary electrode 114 when the contacts 34 and 36 are fully separated defining the gap therebetween. This movement of the electrode 122 is accompanied by leftward movement of the sleeve 120, the leaf spring 124, the flare 125, the finger 126, and the member 152. Leftward movement of the movable electrode 122 is limited by engagement of a screw 157 or the like with the right end of a slot 158 formed in the sleeve 120. The screw 157 may be mounted to the second sleeve 80.

Subsequent reclosing of the contacts 34 and 36 is effected by leftward movement of the operating rod 54. Such leftward movement moves not only the movable contact 36 leftwardly, but also the sleeves 70 and 80 attached to the tube 50. Leftward movement of the sleeves 70 and 80 moves the sleeve 120 and the movable electrode 122 leftwardly due to the force of the spring 150 and the friction between the sliding contact 121 and the sleeve 120. However, due to the previous initial leftward movement of the movable electrode 122 by the compression spring 150, the movable electrodes 122 contact the stationary electrodes 114 prior to re-engagement of the contacts 34 and 36 (see FIG. 3). Arcing occurs between the electrodes 114 and 122 until the electrodes are in physical engagement, at which point the pre-insertion resistors 100 are placed in parallel between the now-closing gap between the contacts 34 and 36. A moment later, the contacts 34 and 36 re-engage as the sleeves 70 and 80 slide relative to the sleeve 120, to condition the interrupting device 10 for normal current carrying. Relative sliding between the sleeves 70, 80 and the sleeve 120 moves the finger 126 toward the openings 128,129 and recompresses the spring 150. Ultimately, the finger 126 reenters the openings 128 and 129 to reengage the shoulder 130. When the contacts 34 and 36 re-engage, they of course shunt the majority of the current away from the pre-insertion resistors 100 which therefore carry current only momentarily.

The function of the pre-insertion resistors 100 is to reduce the inrush current on reclosing of the interrupting device 10. Such inrush current may be especially high and potentially damaging to the circuit containing the device 10, especially when such device 10 switches a capacitor bank, which may result in inrush currents of 30,000 amperes or so. The device 10 is able to withstand fault closing currents as high as 40,000 amperes symmetrical. Initially, when the electrodes 114 and 122 engage, the pre-insertion resistors 100 "see" the full line-to-ground voltage available in the circuit. At this instant, the inrush current is limited by such resistors 100 to a value (2,000–4,000 amperes) equal to the line-to-ground voltage divided by the vector sum of the resistive value of the resistors 100 and the surge impedance of the circuit. Shortly thereafter, current flow through the device 10 is limited by the steady-state impedance of the bank and the rest of the circuit, dropping, typically, to the vicinity of 100 to 400 amperes. When the contacts 34 and 36 re-engage, the 2,000–4,000 ampere current again flows, thus ensuring that only minimal distress of circuit occurs.

One type of rather complicated prior art pre-insertion resistor mechanism is shown in U.S. Pat. No. 4,072,836 to Bischofberger. In U.S. Pat. No. 4,072,836, a stationary auxiliary contact is electrically and mechanically connected to a stationary main contact, the latter being selectively engaged by and disengaged from a movable main contact. A stationary, electrically conductive sleeve surrounds and is in continuous sliding electrical contact with, the movable main contact. A complexly-shaped carrier member is attached to the movable main contact and extends away therefrom through a slot in the sleeve. The carrier holds for sliding movement a multi-material rod, a front portion of which is conductive and an intermediate portion of which is insulative. The conductive front portion of the rod is a movable auxiliary contact positioned to engage and disengage the stationary auxiliary contact. A resistor has one end connected to the sleeve and the other end contacted to a contact member carried by an insulating tube which surrounds the rod and is carried by the sleeve. The contact member is in continuous, sliding electrical contact with the movable auxiliary contact. A spring acts between the carrier and a collar mounted to the rod to bias the movable auxiliary electrode toward the stationary electrode. A latch lever on the carrier is spring biased to engage the collar and to hold the rod and the carrier for joint movement with the carrier. A cam on the sleeve is positioned to disengage the latch lever from the collar when the carrier is in a given position with respect to the sleeve.

When the main contacts and the auxiliary contacts engage, the spring is compressed between the carrier and the collar; the latch lever engages the collar to prevent relative movement of the rod and the carrier. The resistor is paralleled with the engaged main contacts via a path that includes: the movable main contact, the sleeve, the one end of the resistor, the resistor, the other end of the resistor, the contact member, the movable auxiliary contact, the stationary auxiliary contact, and the stationary main contact. The insulative portion of the rod and the insulating tube are required to prevent shorting of the resistors. As the movable main contact moves to separate the main contacts, the carrier moves to separate the auxiliary contacts. After a certain amount of movement by the movable main contact and the carrier, the cam disengages the latch lever from the collar, permitting the spring to move the rod and the movable auxiliary contact back in an advanced position toward the stationary auxiliary contact. Thus, following full opening of the main contacts, when the movable main contact moves toward the stationary main contact, the spring holds the movable auxiliary contact in its advanced position so that the auxiliary contacts engage before the main contacts. This parallels the resistor, via the above-described path, with the closing gap between the main contacts. Following engagement of the auxiliary contacts, relative motion between the carrier and the collar recompresses the spring therebetween. As the main contacts re-engage, the latch lever again latches the collar.

The mechanism of U.S. Pat. No. 4,072,836 is quite complicated to make and to assemble. The structure and nature of the carrier, its attachment to the movable main contact, and the manner of associating the rod therewith are all quite complex. The compound nature of the rod—conductive and non-conductive—is undesirable from a manufacturing standpoint. Additionally, the U.S. Pat. No. 4,072,836 mechanism uses to sliding contact interfaces, one between the contact member and the movable auxiliary contact, and the other between the sleeve and the movable main contact. It is usually desirable to minimize the number of sliding contacts in circuit interrupting devices.

A comparison of the present invention with the U.S. Pat. No. 4,072,836 mechanism will show how much simpler to make and assemble the former is. No complicated carried is required; parts are coaxial and simply configured. There are no compound—conductive, non-conductive—parts. Sliding electrical contacts have been kept to a minimum—one, to be precise.

The above description is intended merely to show one preferred embodiment of the present invention. It should be obvious to those skilled in the art that various changes and modifications therein may be made without departing from the scope of the present invention. For example, the structure of the disclosed interrupting device 10 with which the present invention is described may be altered to varying degrees and still be usable with the pre-insertion resistor mechanism 12 of the present invention. Moreover, other interrupting devices differing substantially from the design of the interrupting device 10 depicted in the Figures may be utilized with the pre-insertion resistor mechanism 12 of the present invention. Such different interrupting devices need only have a member which is movable with, or is tied to, a structure which moves with a movable interrupting contact for carrying the movable electrode structure as described herein. A stationary cam surface, or the like, similar to the cam surface 146 is easily incorporated into the device for permitting free movement of the movable electrode 122 back toward the stationary electrode 114 when the interrupting device is at or near its full opened position.

Figure 4A:
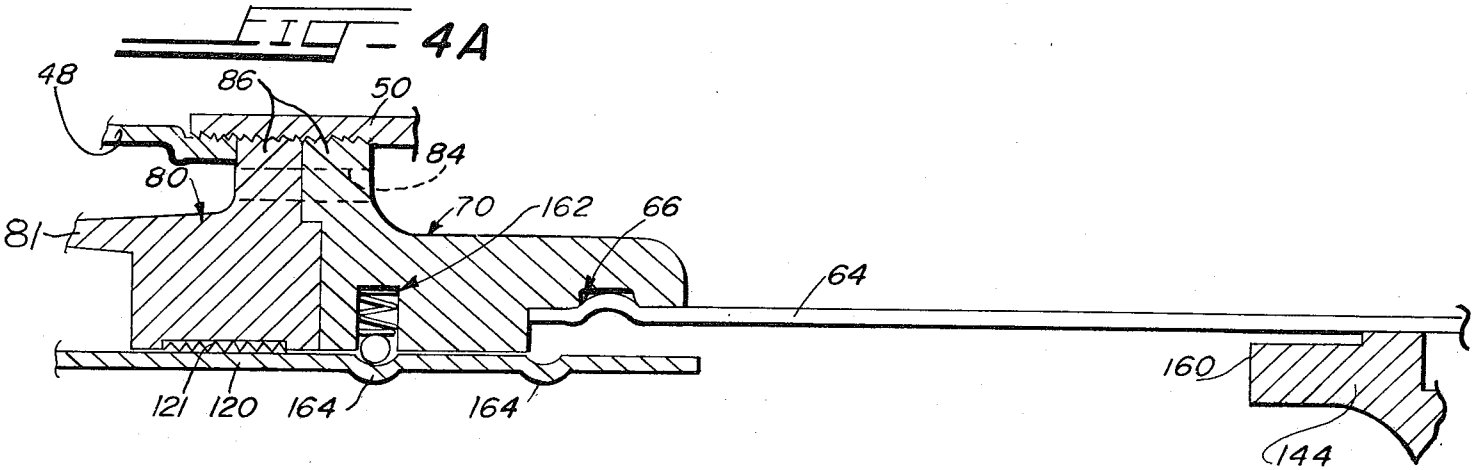
FIGS. 4 and 4B depicts a portion of an alternative embodiment of the mechanism shown in FIGS. 1–3.
Figure 4B:
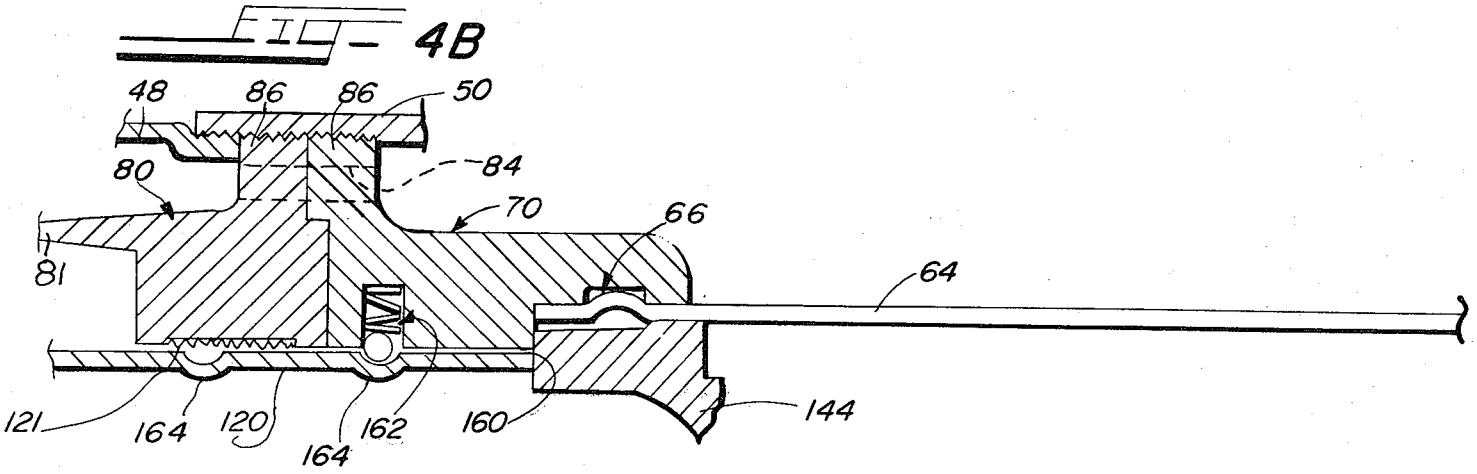

Additionally, it may be desired to simplify the mechanism 12, as for example, by eliminating the spring 150, the finger 126, the leaf spring 124, and the opening 128. In this event, and referring to FIG.4, the cam ring 144 may be modified by forming the cam surfaces 146 into an abutment 160 in the path of the end of the sleeve 120. After sufficient rightward movement of the sleeves 70 and 80, which carry the sleeve 120 therewith due to friction, the abutment 160 is engaged by the sleeve 120, causing it and the electrodes 122 to remain stationary as the sleeves 70 and 80 continue to move. Such action positions the electrodes 122 in their advanced position, similar to that shown in FIG. 3. A ball detent 162 in the sleeve 70 may co-act with one or more dimples 164 formed in the sleeve 120 in aid of the friction between the sliding contact 121 and the sleeve 120 to hold the electrodes 122 advanced during closing of the contacts 34 and 36.

What is claimed is:

1. An improved circuit interrupting device of the type having a pair of normally engaged contacts, at least one of which is relatively movable along a first path, the contacts being selectively disengageable and engageable by such movement to open and close a gap therebetween, each contact being continuously, electrically connected to respective, opposed, circuit-connectable terminals on the device; wherein the improvement comprises:

a pre-insertion resistor mechanism, which includes:

a resistor continuously, electrically connected at one end to one of the terminals, the other end of the resistor carrying a stationary electrode;

a movable electrode continuously, electrically connected to the other terminal and movable along a second path parallel to the first path into and out of engagement with the stationary electrode;

first means, responsive to disengagement of the contacts due to movement of the one contact in a first direction along the first path, for simultaneously moving the movable electrode in the first direction along the second path out of engagement with the stationary electrode so that the resistor is not in electrical parallel with the gap during such movements in the first direction; and second means, responsive to a predetermined amount of movement of the one contact in the first direction, for moving the movable electrode along the second path in a second direction toward the stationary electrode, so that the electrodes engage prior to engagement of the contacts due to the one contact moving toward the other contact in the second direction.

2. A device according to claim 1, wherein the one contact and the movable electrode move at the same rate along their respective paths in both directions.

3. A device according to claim 1, wherein:

the second moving means comprises:

third means responsive to a predetermined amount of movement of the one contact in the first direction for initially moving the movable electrode in the second direction toward, but not into contact with, the stationary electrode prior to movement of the one contact in the second direction, and for thereafter further moving the movable electrode in the second direction conjointly with movement of the one contact in the second direction.

4. A device according to claim 3, wherein:

the third means comprises:

movable member mounting the movable electrode;

spring means for biasing the member to move the movable electrode in the second direction; and means for linking the member to the one contact for movement therewith and for holding the member against the action of the spring means until the predetermined amount of movement of the one contact in the first direction has occurred.

5. A device according to claim 4, wherein:

the third means further comprises:

a sleeve surrounding and connected to the one contact for movement therewith;

a leaf spring carried by the member;

a finger on the leaf spring normally engaging the shoulder and so arranged with respect thereto that movement of the one contact in the first direction carries the member and the movable electrode in the first direction, the engaged shoulder and finger preventing movement of the member by the spring means; and a stationary cam which disengages the finger from the shoulder by flexing the leaf spring when the predetermined amount of movement of the one contact in the first direction has occurred.

6. A device according to claim 5, wherein:

the spring means comprises:

a first abutment on the member;

a second abutment on the sleeve; and a compression spring acting between the abutments.

7. A pre-insertion resistor mechanism for a circuit interrupting device, the device having a pair of elongated, normally engaged contacts, one of which is stationary, the other of which is axially relatively movable for separation of the contacts to open a gap therebetween, the contacts being continuously, electrically connected to respective, opposed circuit-connectable terminals on the device; and an elongated, insulative housing containing an arc-extinguishing gas, the housing coaxially surrounding the contacts and coaxially mounting the terminals; the mechanism comprising:

an elongated resistor within the housing positioned radially away from and parallel to the axis thereof, the resistor having one end continuously, electrically connected to the one contact;

a stationary electrode on the other end of, and on the axis of, the resistor;

a conductive sleeve axially movable along the axis of the housing and coaxially surrounding the other contact while being continuously, electrically connected thereto;

an electrode movable along the axis of the housing and carried by the sleeve for selective engagement with, and disengagement from, the stationary electrode upon movement of the sleeve; and means, partially on the sleeve and positioned radially away from the axis of the housing, for engaging the electrodes when the contacts are engaged, disengaging the electrodes no later than the separation of the contacts, and re-engaging the electrodes prior to re-engagement of the contacts.

8. A mechanism according to claim 7, wherein the means comprises:

a movable member coaxial with the housing for moving the other contact;

spring biased means partially on the sleeve and partially on the member for effecting conjoint movement of the sleeve and the member; and stationary means positioned radially away from the axis of the housing for disabling the spring biased means in response to a predetermined amount of separating movement by the other contact for moving the movable electrode back toward the stationary electrode prior to re-engagement of the contact so that the electrodes re-engage prior to the contacts.

9. A mechanism according to claim 8, wherein the spring biased means comprises:

a ball detent in the member, and a dimple in the sleeve co-acting with the ball detent; and the disabiling means comprises:

a stationary abutment positioned radially away from the axis of the housing which engages an end of the sleeve after the predetermined amount of separating movement by the other contact to hold the sleeve and the movable electrode stationary as the other contact continues its separating movement.

10. A mechanism according to claim 8, wherein the spring biased means comprises:

a leaf spring coaxially carried at one end by the sleeve;

a finger carried on the other end of the leaf spring; and a shoulder on the member normally engaged by the finger; and the disabling means comprises:

a stationary cam surface radially positioned away from the axis of the housing which engages and flexes the leaf spring after the predetermined amount of separating movement by the other contact so that the finger disengages the shoulder, and a spring acting between the member and the sleeve for moving the sleeve and the movable electrode back toward the stationary electrode after the finger disengages the shoulder.

11. An improved high-voltage circuit interrupter of the type having a stationary and a movable contact respectively connectable by terminals to opposed sides of a circuit and selectively engageable or disengageable upon movement of a rod connected to the movable contact; a pressurized dielectric-gas-filled housing for the contacts and for mounting the terminals; and a pre-insertion resistor connected in an electrically parallel path with the main contacts when engaged, the pre-insertion resistor being disconnected from the path and the circuit prior to disengagement of the contacts and being connected in the circuit prior to engagement of the contacts following a previous disengagement thereof; wherein the improvement comprises:

means for mounting the resistor so that one side of the resistor is permanently connected to one of the terminals;

a stationary resistor electrode on the other side of the resistor;

a first electrically conductive cylindrical member surrounding a portion of the rod and axially movable therewith;

means for continuously, electrically connecting the first member to the other terminal;

a second electrically conductive cylindrical member surrounding the rod and the first member, the second member being axially movable relative to the first member;

a movable resistor electrode mounted on the second member for engagement with and disengagement from the stationary resistor electrode upon movement of the second member;

means for continuously biasing the members apart so as to bias the resistor electrodes toward engagement;

means for preventing relative movement of the members to effect conjoint movement of the members as the rod moves to open the contacts so that the resistor electrodes disengage before the contacts disengage; and means for disabling the preventing means after disengagement of the contacts and of the resistor electrodes so that the biasing means moves the second member relative to the first member to position the movable resistor electrode so as to engage the stationary resistor electrode before the contacts engage upon movement of the rod, movement of the rod to engage the contacts ultimately re-enabling the preventing means.

12. An interrupter according to claim 11, wherein the members are normally telescoped;

the biasing means comprises a compression spring acting between the members;

the preventing means comprises a leaf spring on the second member, a finger on the leaf spring, and a shoulder on the first member, the leaf spring normally maintaining the finger against the shoulder; and the disabling means comprises stationary cam surface means which engages the leaf spring after disengagement of the resistor electrodes and of the main contacts for moving the finger away from the shoulder against the leaf spring to permit the compression spring to relatively move the members so as to move the movable electrode back toward the stationary electrode.

13. Improved apparatus for electrically connecting a pre-insertion resistor across a gap previously opened between interrupting contacts of a circuit interrupting device, connection of resistor occurring prior to the closing of the contacts, wherein the improvement comprises:

means for continuously, electrically connecting the one side of the resistor to one of the contacts;

stationary electrode means continuously, electrically connected to the other side of the resistor;

movable electrode means continuously, electrically connected to the other contact for (a) engaging the stationary electrode means when the contacts are closed to electrically parallel the resistor with the closed contacts.

(b) disengaging the stationary electrode no later than the opening of the contacts so that the resistor is not in parallel with the gap during such opening, and (c) positioning the movable electrode as the gap is opened and in response to a predetermined amount of movement of the movable electrode means so that the electrodes re-engage prior to closing of the contacts.

* * * * *